US005961821A

United States Patent [19]

Varadaraj et al.

[11] Patent Number: 5,961,821

[45] Date of Patent: Oct. 5, 1999

[54] REMOVAL OF NAPHTHENIC ACIDS IN CRUDE OILS AND DISTILLATES

[75] Inventors: Ramesh Varadaraj, Flemington; David William Savage, Lebanon; William Edward Wales, Phillipsburg, all of N.J.

[73] Assignee: Exxon Research and Engineering Co, Florham Park, N.J.

[21] Appl. No.: 09/049,466

[22] Filed: Mar. 27, 1998

[51] Int. Cl.[6] ..... C10G 17/00

[52] U.S. Cl. ..... 208/263

[58] Field of Search ..... 208/263

[56] References Cited

U.S. PATENT DOCUMENTS

| | | | |
|---|---|---|---|
| 2,424,158 | 7/1947 | Fuqua et al. . | |
| 4,420,414 | 12/1983 | Valone | 106/14.18 |
| 4,622,047 | 11/1986 | Bernasconi et al. | 44/63 |
| 4,752,381 | 6/1988 | Ferguson et al. . | |
| 5,582,792 | 12/1996 | Dougherty | 106/14.41 |
| 5,792,420 | 8/1988 | Brezinnski | 166/307 |

*Primary Examiner*—Helane Myers
*Attorney, Agent, or Firm*—Estelle C. Bakun

[57] ABSTRACT

The instant invention is directed to a process for extracting organic acids including naphthenic acids, heavy metals, and sulfur from a starting crude oil comprising the steps of:

(a) treating the starting crude oil containing organic acids, heavy metals, and sulfur with an amount of an ethoxylated amine and water under conditions and for a time and at a temperature sufficient to form a water-in-oil emulsion of amine salt wherein said ethoxylated amine has the following formula:

where m=1 to 10 and R=$C_3$ to $C_6$ hydrocarbon;

(b) separating said emulsion of step (a) into a plurality of layers, wherein one of such layers contains a treated crude oil having decreased amounts of organic acids, heavy metals and sulfur;

(c) recovering said layer of step (b) containing said treated crude oil having decreased amounts of organic acids, heavy metal and sulfur and layers containing water and ethoxylated amine salt.

21 Claims, 3 Drawing Sheets

REMOVAL OF NAPHTHENIC ACIDS IN CRUDE OILS AND DISTILLATES

FIELD OF THE INVENTION

The instant invention is directed to the removal of organic acids, heavy metals and sulfur in crude oils, crude oil blends and crude oil distillates using a specific class of compounds.

BACKGROUND OF THE INVENTION

High Total Acid Number (TAN) crudes are discounted by about 0.50/TAN/BBL. The downstream business driver to develop technologies for TAN reduction is the ability to refine low cost crudes. The upstream driver is to enhance the market value of high TAN, metals, and sulfur containing crudes.

The current approach to refine acidic crudes is to blend the acidic crudes with nonacidic crudes so that the TAN of the blend is no higher than about 0.5. Most major oil companies use this approach. The drawback with this approach is that it limits the amount of acidic crude that can be processed. Additionally, it is known in the art to treat the crudes with inorganic bases such as potassium and sodium hydroxide to neutralize the acids. This approach, however, forms emulsions which are very difficult to break and, additionally, undesirably leaves potassium or sodium in the treated crude. Furthermore, such prior art techniques are limited by the molecular weight range of the acids they are capable of removing.

With the projected increase of acidic crudes in the market (Chad, Venezuela, North Sea), new technologies are needed to further refine higher TAN crudes and crude blends. Thermal treatment, slurry hydroprocessing and calcium neutralization are some of the promising approaches that have emerged. However, these technologies do not extract the acids, metals or sulfur from the crudes. Instead, they convert the acids to products that remain in the crude. Likewise, removal of heavy metals, e.g., organo vanadium and nickel compounds and sulfur is desirable to prevent catalyst fouling during upgrading and to address environmental concerns.

U.S. Pat. No. 4,752,381 is directed to a method for neutralizing the organic acidity in petroleum and petroleum fractions to produce a neutralization number of less than 1.0. The method involves treating the petroleum fraction with a monoethanolamine to form an amine salt followed by heating for a time and at a temperature sufficient to form an amide. Such amines will not afford the results desired in the instant invention since they convert the naphthenic acids to other products, whereas the instant invention extracts the naphthenic acids.

U.S. Pat. No. 2,424,158 is directed to a method for removing organic acids from crude oils. The patent utilizes a contact agent which is an organic liquid. Suitable amines disclosed are mono-, di-, and triethanolamine, as well as methyl amine, ethylamine, n- and isopropyl amine, n-butyl amine, sec-butyl amine, ter-butyl amine, propanol amine, isopropanol amine, butanol amine, sec-butanol, sec-butanol amine, and ter-butanol amine.

SUMMARY OF THE INVENTION

The instant invention is directed to a process for extracting organic acids including naphthenic acids, heavy metals, and sulfur from a starting crude oil comprising the steps of:

(a) treating the starling crude oil containing organic acids, heavy metals, and sulfur with an amount of an ethoxylated amine and water under conditions and for a time and at a temperature sufficient to form a water-in-oil emulsion of amine salt wherein said ethoxylated amine has the following formula:

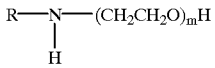

where m=1 to 10 and R=$C_3$ to $C_6$ hydrocarbon;

(b) separating said emulsion of step (a) into a plurality of layers, wherein one of such layers contains a treated crude oil having decreased amounts of organic acids, heavy metals and sulfur;

(c) recovering said layer of step (b) containing said treated crude oil having decreased amounts of organic acids, heavy metal and sulfur and layers containing water and ethoxylated amine salt.

The present invention may suitably comprise, consist or consist essentially of the elements disclosed herein and may be practiced in the absence of an element not disclosed.

DETAILED DESCRIPTION OF THE INVENTION

Figure 1:
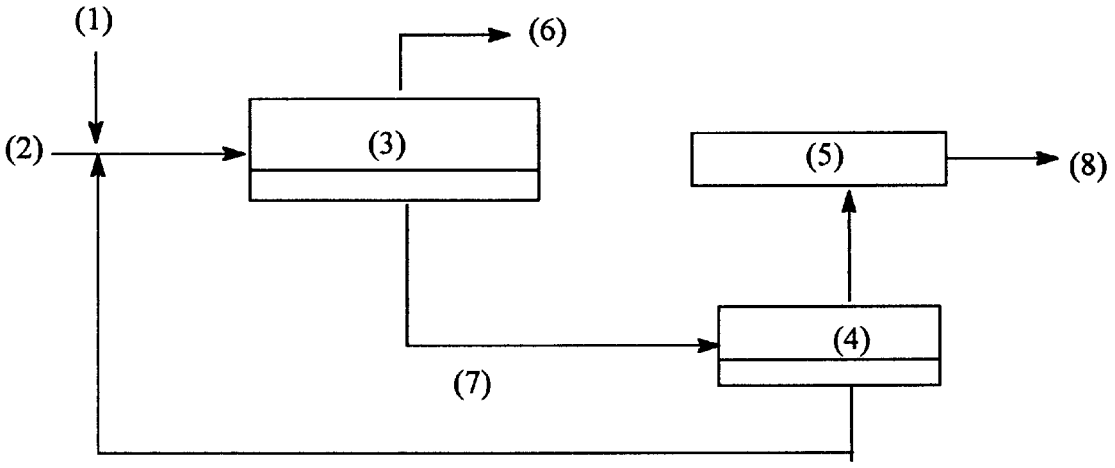
FIG. 1 is a flow diagram depicting how the process can be applied to existing refineries. (1) is water and ethoxylated amine, (2) is starting crude oil, (3) is the desalter, (4) is the regeneration unit, (5) is the organic acid conversion unit, (6) is treated crude having organic acids removed, (7) is lower phase emulsion, and (8) is products.

In the instant invention ethoxylated amines of the following formula

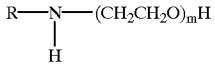

are added to a starting crude oil to remove organic acids, heavy metals, e.g., organo vanadium and nickel compounds, and sulfur. Some crude oils contain organic acids that generally fall into the category of naphthenic acids and other organic acids. Naphthenic acid is a generic term used to identify a mixture of organic acids present in a petroleum stock. Naphthenic acids may be present either alone or in combination with other organic acids, such as sulfonic acids and phenols. Thus, the instant invention is particularly suitable for extracting naphthenic acids.

The important characteristics of the ethoxylated amines are that the alkyl groups be such that the amine is miscible in the oil to be treated, and that the ethoxy groups impart water solubility to the salts formed. In the above formula, m is 1 to 10, preferably 1 to 5, R=$C_3$ to $C_6$ hydrocarbon. R may be branched or linear. For example, suitable R groups are tertiary butyl, tertiary amyl, neopentyl, and cyclohexyl, preferably R will be tertiary butyl and m will be 2. Surprisingly, a primary amine (R=H), although soluble in water and a strong base does not remove the organic acids, including naphthenic acids as described in the instant invention.

In the instant invention, organic acids, including naphthenic acids which are removed from the starting crude oil or blends are preferably those having molecular weights ranging from about 150 to about 800, more preferably, from about 200 to about 750. The instant invention, preferably substantially extracts or substantially decreases the amount of naphthenic acids present in the starting crude. By substantially is meant all of the acids except for trace amounts. However, it is not necessary for substantially all of the acids to be removed since the value of the treated crude is increased if even a portion of the naphthenic acids are removed. Applicants have found that the amount of naphthenic acids can be reduced by at least about 70%, preferably at least about 90% and, more preferably, at least about 95%. The amount of heavy metals may be reduced by at least about 5%, preferably, at least about 10% and, most preferably, by at least about 20%. The amount of sulfur by at least about 5%, preferably about 10% and, most preferably, about 17%. Particularly, vanadium and nickel will be reduced.

Starting crude oils (starting crudes) as used herein include crude blends and distillates. Preferably, the starting crude will be a whole crude, but can also be acidic fractions of a whole crude such as a vacuum gas oil. The starting crudes are treated with an amount of ethoxylated amine capable of forming an amine salt with the organic acids present in the starting crude. This will be the amount necessary to neutralize the desired amount of acids present. Typically, the amount of ethoxylated amine will range from about 0.15 to about 3 molar equivalents based upon the amount of organic acid present in the crude. If one chooses to neutralize substantially all of the naphthenic acids present, then a molar excess of ethoxylated amine will be used. Preferably 2.5 times the amount of naphthenic acid present in the crude will be used. The molar excess allows for higher weight molecular acids to be removed. The instant invention is capable of removing naphthenic acids ranging in molecular weight from about 150 to about 800, preferably about 250 to about 750. The weight ranges for the naphthenic acids removed may vary upward or downward of the numbers herein presented, since the ranges are dependent upon the sensitivity level of the analytical means used to determine the molecular weights of the naphthenic acids removed.

The ethoxylated amines can be added alone or in combination with water. If added in combination, a solution of the ethoxylated amine and water may be prepared. Preferably, about 5 to 10 wt % water is added based upon the amount of crude oil. Whether the amine is added in combination with the water or prior to the water, the crude is treated for a time and at a temperature at which a water in oil emulsion of ethoxylated amine salts of organic acids will form. Contacting times depend upon the nature of the starting crude to be treated, its acid content, and the amount of ethoxylated amine added. The temperature of reaction is any temperature that will effect reaction of the ethoxylated amine and the naphthenic acids contained in the crude to be treated. Typically, the process is conducted at temperatures of about 20 to about 220° C., preferably, about 25 to about 130° C. and, more preferably, about 25 to about 80° C. Pressures will range from about atmospheric pressure, preferably from about 60 psi and, most preferably, from about 60 to about 1000 psi. The contact times will range from about 1 minute to 1 hour, preferably about 3 to about 30 minutes. Heavier crudes will preferably be treated at the higher temperatures and pressures. The crude containing the salts is then mixed with water, if stepwise addition is performed, at a temperature and for a time sufficient to form an emulsion. The times and temperatures remain the same for simultaneous addition and stepwise addition of the water. If the addition is done simultaneously, the mixing is conducted simultaneously with the addition at the temperatures and for the times described above. It is not necessary for the simultaneous addition to mix for a period in addition to the period during which the salt formation is taking place. Thus, treatment of the starting crude includes both contacting and agitation to form an emulsion, for example, mixing. Heavier crudes, such as those with API indices of 20 or lower and viscosities greater than 200 cP at 25° C., preferably will be treated at temperatures above 60° C.

Once the water-in-oil emulsion has been formed, it is separated into a plurality of layers. The separation can be achieved by means known to those skilled in the art. For example, centrifugation, gravity settling, and electrostatic separation. A plurality of layers results from the separation. Typically, three layers will be produced. The uppermost layer contains the crude oil from which the acids, heavy metals, and sulfur have been removed. The middle layer is an emulsion containing ethoxylated amine salts of high and medium weight acids and surface active organo vanadium and nickel compounds and sulfur compounds, while the bottom layer is an aqueous layer containing ethoxylated amine salts of low molecular weight acids. The uppermost layer containing treated crude is easily recoverable by the skilled artisan. Thus, unlike the treatments used in the past whereby the acids are converted into products which remain in the crude, the instant process removes the acids from the crude.

Additionally, though not required, demulsification agents may be used to enhance the rate of demulsification and co-solvents, such as alcohols, may be used along with the water.

The process can be conducted utilizing existing desalter units.

FIG. 1 depicts the instant process when applied in a refinery. The process is applicable to both production and refining operations. The acidic oil stream is treated with the required amount of ethoxylated amine by adding the amine to the wash water and mixing with a static mixer at low shear. Alternatively, the ethoxylated amine can be added first, mixed and followed by water addition and mixing. The treated starting crude is then subjected to demulsification or separation in a desalting unit which applies an electrostatic field or other separation means. The oil with reduced TAN, metals and sulfur is drawn off at the top and subjected to further refining if desired. The lower aqueous and emulsion phases are drawn off together or separately, preferably together and discarded. They may also be processed separately to recover the treating amine. Likewise, the recovered aqueous amine solution may be reused and a cyclic process obtained. The naphthenic acid stream may be further treated, by methods known to those in the art, to produce a non-corrosive product, or discarded as well.

Figure 2:
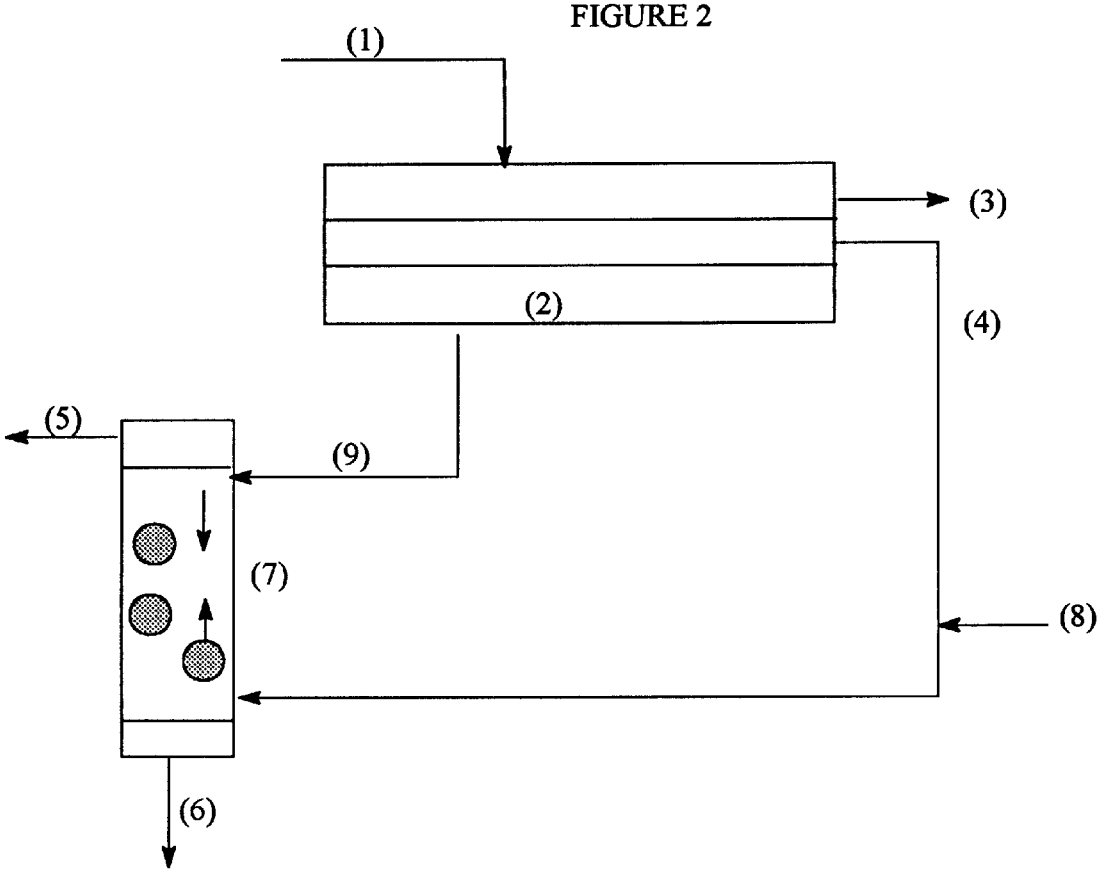
FIG. 2 is a flow scheme depicting the application of the instant invention at the well head. (1) is a full well stream, (2) is a primary separator, (3) is gas, (4) is crude, (5) is treated (upgraded) crude, (6) is water and organic acid, (7) is a contact tower, (8) is ethoxylated amine, and (9) is water.

In a production process, the instant invention would be especially applicable at the well head. At the well head, starting crudes typically contain co-produced water and gases. FIG. 2 illustrates the applicability of the instant invention at the well head. In FIG. 2, a full well stream containing starting crude, water and gases is passed into a separator, and separated into a gas stream which is removed, a water stream which may contain trace amounts of starting crude, and a starting crude stream (having water and gases removed) which may contain trace amounts of water. The water and crude streams are then passed into a contact tower. Ethoxylated amine can be added to either the crude or water and the instant treatment and mixing carried out in the contact tower. The water and crude streams are passed in a countercurrent fashion in the contact tower, in the presence of ethoxylated amine, to form an unstable oil-in-water emulsion. An unstable emulsion is formed by adding the acidic crude oil with only mild agitation to the aqueous phase in a sufficient ratio to produce a dispersion of oil in a continuous aqueous phase. The crude oil should be added to the aqueous phase rather than the aqueous phase being added to the crude oil, in order to minimize formation of a stable water-in-oil emulsion. A ratio of 1:3 to 1:15, preferably 1:3 to 1:4 of oil to aqueous phase is used based upon the weight of oil and aqueous phase. A stable emulsion will form if the ratio of oil to aqueous phase is 1 to 1 or less. The amount of ethoxylated amine will range from about 0.15 to about 3 molar equivalents based upon the amount of organic acid present in the starting crude. Aqueous phase is either the water stream if ethoxylated amine is added directly to the crude or ethoxylated amine and water, if the ethoxylated amine is added to the water. Droplet size from 10 to 50 microns, preferably 20–50 microns is typically needed. Contacting of the crude oil and aqueous ethoxylated amine should be carried out for a period of time sufficient to disperse the oil in the aqueous ethoxylated amine preferably to cause at least 50% by weight, more preferably at least 80%, most preferably 90% of the oil to disperse in the aqueous ethoxylated amine. The contacting is typically carried out at temperatures ranging from about 10° C. to about 40° C. At temperatures greater than 40° C., the probability of forming a stable emulsion increases. The naphthenic acid ammonium salts produced are stripped off the crude droplets as they rise from the bottom of the contact tower. The treated crude is removed from the top of the contact tower and water containing ethoxylated amine salts of naphthenic acids (lower layers) is removed from the bottom of the contact tower. In this way, an upgraded crude having naphthenic acids removed therefrom is recovered at the well head. The treated crude may then be treated, such as electrostatically, to remove any remaining water and naphthenic acids if desired.

The water and organic acid ethoxylated amine salt byproducts removed from the contact tower can be reinjected into the ground. However, due to the cost of the ethoxylated amine, it will be desirable to perform a recovery step prior to reinjection.

The recovered ethoxylated amine can then be reused in the process, thereby creating a cyclic process.

If it is desirable to regenerate the organic acids, including naphthenic acids and ethoxylated amines, the following process can be used. The method comprises the steps of (a) treating the layers remaining following removal of said treated crude layer including said emulsion layer, with an acidic solution selected from the group comprising mineral acids or carbon dioxide, at a pressure and pH sufficient to produce naphthenic acids and an amine salt of said mineral acid when mineral acid is used or amine bicarbonate when carbon dioxide is used, (b) separating an upper layer containing naphthenic acids and a lower aqueous layer; (c) adding, to the lower aqueous layer, an inorganic base if step (a) utilizes a mineral acid, or heating at a temperature and for a time sufficient, if step (a) utilizes carbon dioxide to raise the pH to ≧8; (d) blowing gas through said aqueous layer to create a foam containing said ethoxylated amines; (e) skimming said foam to obtain said ethoxylated amines. The foam may further be collapsed or will collapse with time. Any gas can be used to create the foam provided it is unreactive or inert in the instant process, however, preferably air will be used. Those skilled in the art can readily select suitable gases. If it is desirable to collapse the foam, chemicals known to the skilled artisan can be used, or other known mechanical techniques.

In the method used to recover the ethoxylated amines, a mineral acid may be used to convert any ethoxylated amine salts of naphthenic acid formed during naphthenic acid removal from a starting crude. The acids may be selected from sulfuric acid, hydrochloric acid, phosphoric acid and mixtures thereof. Additionally, carbon dioxide may be added to the emulsion of amine ethoxylated salts under pressure. In either scenario, the acid addition is continued until a pH of about 6 or less is reached, preferably about 4 to 6. Acid addition results in formation of an upper naphthenic acid containing oil layer, and a lower aqueous layer. The layers are then separated and to the aqueous layer is added an inorganic base such as ammonium hydroxide, sodium hydroxide, potassium hydroxide or mixtures thereof, if a mineral acid was used, to obtain a pH of greater than about 8. Alternatively, the aqueous layer is heated at a temperature and for a time sufficient, if carbon dioxide is used to obtain a pH of greater than about 8. Typically, the layer will be heated to about 40 to about 85° C., preferably about 80° C. A gas, for example, air, nitrogen, methane or ethane, is then blown through the solution at a rate sufficient to create a foam containing the ethoxylated amines. The foam is then recovered and collapsed to obtain the ethoxylated amine. The recovery process can be used either in the refinery or at the well head prior to reinjection.

The invention will now be illustrated by the following examples which are not meant to be limiting.

EXAMPLE 1

In this example a 40/30/30 "ISOPAR-M"/Solvent 600 Neutral/Aromatic 150 was used as a model oil. "ISOPAR M" is an isoparaffmfic distillate, Solvent 600 Neutral is a base oil, and Aromatic 150 is an aromatic distillate. 5-β cholanic acid was used as the model naphthenic acid and octaethyl prorphyrin vanadium oxide as the heavy metal.

The acidic crude was treated with an equimolar amount (based upon the amount of 5-β cholanic acid) of a secondary amine ethoxylate where R=t-butyl and m=2.5 wt % water was added and the treated oil mixed. The emulsion that formed was centrifuged to separate the naphthenic acid as its salt and organo vanadium into an emulsion phase.

In this example, 2 wt % of 5-β cholanic acid and 0.05 wt % octaethyl prorphyrin vanadium oxide were solubilized in the model oil and subjected to the emulsion fractionation process herein described (mixing for 15 minutes at room temperature) using tertiary butyl diethanol amine. The total acid number of the model oil dropped from 4.0 to 0.23, and a 23% drop in octaethyl vanadium prorphyrin oxide was observed. High Performance Liquid Chromatography revealed a 99% removal of the 5-β cholanic acid from the treated oil.

EXAMPLE 2

A North Sea Crude (Gryphon) having a TAN of 4.6 was utilized in this example. Tertiary butyl diethanol amine was used at varying amine treat rate and wt % water addition. The results are tabulated in Table 1.

TABLE 1

Amine to Acid mole ratio = 2.5.
Temperature of mixing = 25° C.
Time of mixing = 5 to 30 minutes
Volume of wash water = 5 to 10 wt %
Mixing of wash water = gentle tumbling of oil/water mixture for 10 to 15 minutes
Separation = Centrifugation at 1800 rpm for 30 minutes or electrostatic demulsification at 80° C. for 30 minutes

| Amine | Amine Treat Rate (mole equivalents) | Water Wt % | TAN after treat |
|---|---|---|---|
| tbutyl—N(H)—$(EO)_2H$ | 1.2 | 5 | 1.2 |
| tbutyl—N(H)—$(EO)_2H$ | 2.5 | 5 | 1 |
| none | 0 | 10 | 4.2 |

EXAMPLE 3

A Venezuelan crude was treated as described in Example 2 (2.5 mole equivalent of amine and 5 w % water) and a TAN reduction from 2.2 to 1.1, a 13% reduction in vanadium, and a 17% reduction in sulfur were observed. The extraction temperature was 80° C., at atmospheric pressure and time=1 hour. A performance improvement in TAN reduction from 2.2 to 0.6 was observed when the extraction temperature was 180° C., the pressure 60 psi, and time=1 hour.

EXAMPLE 4

A Chad crude Bolobo 2/4 having a TAN of 7.3, a viscosity of about 6000 cP at 25° C. and 10 $sec^{-1}$ and an API gravity of 16.8 was used in this example. It was treated according to the conditions set forth in Example 3. A TAN reduction from 7.3 to 3.9 was observed.

EXAMPLE 5

Regeneration of Amine Using Mineral Acid

A North Sea crude, Gryphon, was subjected to the emulsion fractionation process described in Example 2. The lower emulsion phase was extracted and used as follows.

Figure 3:
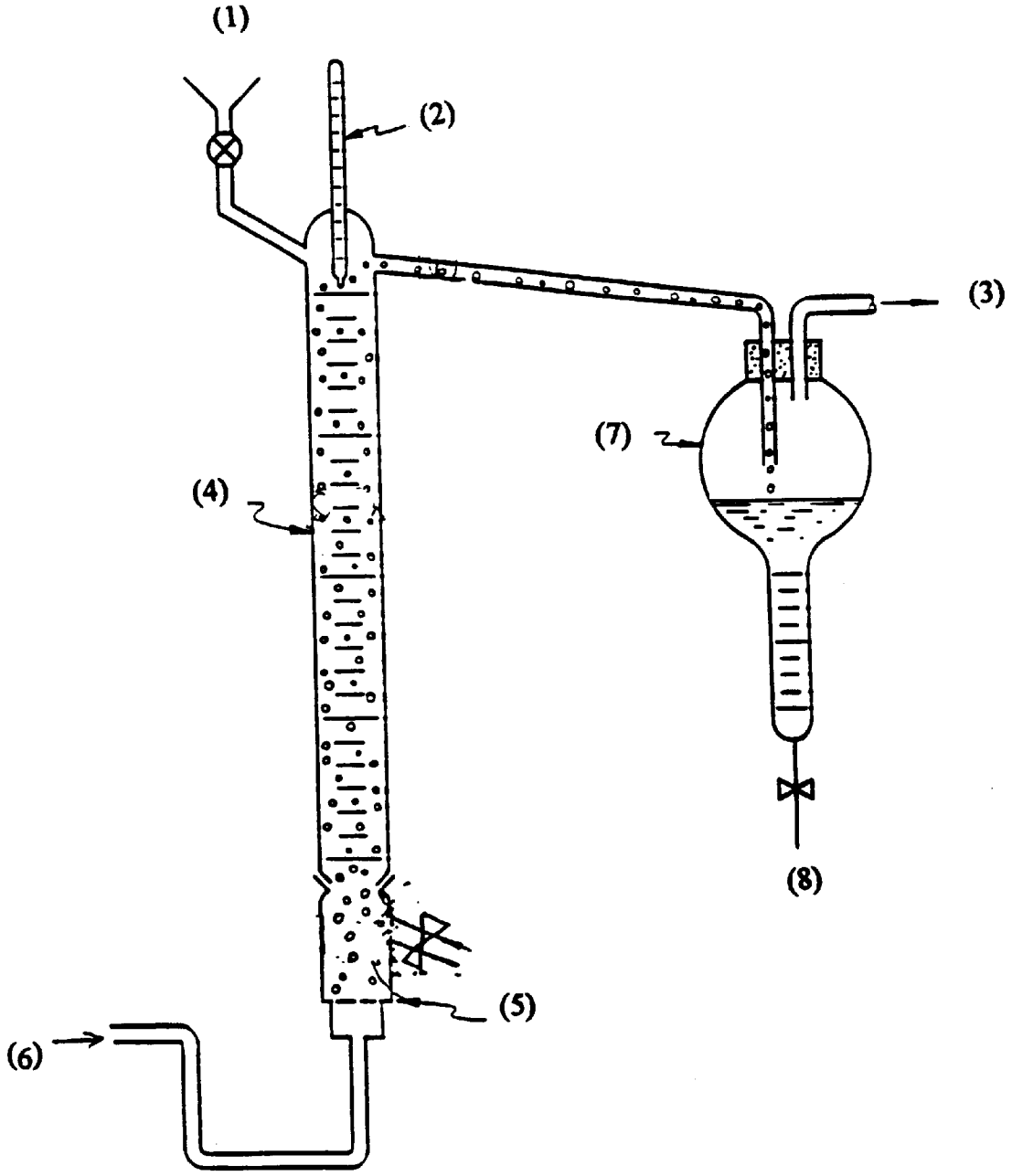
FIG. 3 is an apparatus usable in recovering ethoxylated amines that have been used to remove naphthenic acids from a starting crude. (1) is a layer or phase containing ethoxylated amine, (2) is a thermometer, (3) is a vent, (4) is a graduated column for measuring foam height, (5) is a gas distributor, (6) is gas, (7) is where the foam breaks, and (8) where the recovered ethoxylated amine is collected.

100 mL of the emulsion was taken in a separatory funnel and concentrated sulfuric acid added to bring it to a pH of 6. An instant release of naphthenic acid as a water insoluble oil was observed. The lower aqueous phase was separated from the oil phase. The oil phase was analyzed by FTIR and $^{13}C$ NMR to confirm the presence of naphthenic acids. HPLC analysis indicated 250 to 750 molecular weight naphthenic acids were extracted. Ammonium hydroxide was added to the aqueous phase to obtain a pH of 9. The aqueous solution was introduced into the foam generation apparatus shown in FIG. 3. Air was bubbled through the inlet tube at the bottom to generate a stable sustained foam that was collected in the collection chamber. The foam collapsed upon standing resulting in a yellow liquid characterized as a concentrate of tertiary butyl diethanol amine.

EXAMPLE 6

Regeneration of Amine using $CO_2$

A North Sea Crude, Gryphon, was subjected to the emulsion fractionation process described in Example 2. The lower emulsion phase was extracted and used as follows.

100 mL of the emulsion was taken into an autoclave, solid $CO_2$ added and the emulsion was stirred at 300 rpm at 80° C. and 100 psi for 2 hours. The product was centrifuged for 20 minutes at 1800 rpm to separate the water insoluble naphthenic acids from the aqueous phase. The oil phase was analyzed by FTIR and $^{13}C$ NMR to confirm the presence of naphthenic acid. HPLC analysis indicated 250 to 750 molecular weight naphthenic acids were extracted.

The lower aqueous phase was at a pH of 9 indicating regeneration of the organic amine. The aqueous solution was introduced into the foam generation apparatus shown in FIG. 3. Air was bubbled through the inlet tube at the bottom to generate a stable sustained foam that was collected in the collection chamber. The foam collapsed upon standing resulting in a yellow liquid characterized as a concentrate of tertiary butyl diethanol amine.

What is claimed is:

1. A process for removing organic acids, heavy metals, and sulfur from a starting crude oil comprising the steps of:

(a) treating the starting crude oil containing organic acids, heavy metals, and sulfur with an amount of an ethoxylated amine and water under conditions and for a time and at a temperature sufficient to form a water in oil emulsion of amine salt wherein said ethoxylated amine has the following formula

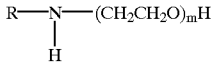

where m=1 to 10 and R=$C_3$ to $C_6$ hydrocarbon;

(b) separating said emulsion of step (a) into a plurality of layers, wherein one of such layers contains a treated crude oil having decreased amounts of organic acids, heavy metals and, sulfur;

(c) recovering said layer of step (b) containing said treated crude oil having decreased amounts of organic acids, heavy metal and sulfur and layers containing water and ethoxylated amine salt.

2. The process of claim 1 wherein said water is added simultaneously with or following said ethoxylated amine.

3. The process of claim 1 wherein said organic acids range in molecular weight from about 150 to about 800.

4. The process of claim 1 wherein said starting crude is a crude oil, crude oil blend, crude oil distillate or crude oil fraction.

5. The process of claim 1 wherein said amount of ethoxylated amine is about 0.15 to about 3.0 molar equivalents based on the amount of organic acids.

6. The process of claim 1 wherein said steps (a) and (b) are conducted at temperatures of about 20 to about 220° C.

7. The process of claim 1 wherein said steps (a) and (b) are conducted for times of about 1 minute to about 1 hour.

8. The process of claim 6 wherein when said starting crude has an API index of about 20 or greater, said temperature is preferably about 60° C.

9. The process of claim 1 wherein said separation step (c) is achieved using gravity settling, electrostatic field separation, centrifugation or a combination thereof.

10. The process of claim 1 wherein co-solvents can be added with said water.

11. The process of claim 1 wherein demulsifiers are added to said separation step.

12. The process of claim 1 wherein said process is conducted in a refinery and said separation is conducted in a desalting unit to produce a layer containing a treated crude having organic acids, heavy metals and sulfur removed therefrom, and a layer containing water and ethoxylated amine salts.

13. The process of claim 1 wherein said process is conducted at a well head and said starting crude is contained in a full well stream from said well head and comprising passing said full well stream into a separator to form a gas stream, a starting crude stream containing naphthenic acids and a water stream; countercurrently contacting said starting crude oil with an amount of said water stream in the presence of an amount of an ethoxylated amine for a time and at a temperature sufficient to form an amine salt wherein said ethoxylated amine has the following formula

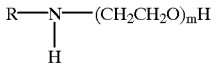

where m=1 to 10 and R=$C_3$ to $C_6$ in a contact tower, at a time and temperature sufficient to form an unstable oil in water emulsion.

14. The process of claim 1 wherein said organic acids are naphthenic acids.

15. A method according to claims 1, 12, or 13 for recovering said ethoxylated amine further comprising (a) contacting the layer containing ethoxylated amine salt of organic acids with an acid selected from the group comprising mineral acids or carbon dioxide in an amount sufficient and under conditions to produce organic acids and amine salt if mineral acid is used or amine carbonate salt if carbon dioxide is used; (b) separating an upper layer containing organic acids and a lower aqueous layer; (c) adding, to the lower aqueous layer, an inorganic base if step (a) utilizes a mineral acid, or heating at a temperature and for a time sufficient if step (a) utilizes carbon dioxide, to raise the pH of the aqueous layer to greater than or equal to 8; (d) blowing a gas through said aqueous layer to produce a foam containing said ethoxylated amine; (e) recovering said foam containing said ethoxylated amine.

16. The method of claim 15 wherein said mineral acid is selected from the group consisting of sulfuric acid, hydrochloric acid, phosphoric acid and mixtures thereof.

17. A method according to claim 15 wherein when said regeneration is applied in a refinery, said recovered ethoxylated amine is recycled in the process.

18. The method of claim 1 wherein said heavy metals are vanadium and nickel.

19. The method of claim 1 wherein R is selected from t-butyl, tertiary amyl, neopentyl, and cyclohexyl.

20. The method of claim 13 wherein the ratio of said water to said starting crude is 1:3 to 1:15.

21. The method of claim 1 wherein said amount of water is about 5 to about 10 wt % based upon the amount of starting crude.

* * * * *